US010581182B2

(12) United States Patent
Gonzalez et al.

(10) Patent No.: US 10,581,182 B2
(45) Date of Patent: Mar. 3, 2020

(54) SPRING CLIP ELECTRICALLY CONNECTING A WIRE AND ELECTRONIC COMPONENT

(71) Applicant: EPCOS AG, München (DE)

(72) Inventors: Alvaro Gonzalez, Alhaurin de la Torre (ES); Francisco Gonzalez, Malaga (ES); Tomas Wagner, Malaga (ES)

(73) Assignee: EPCOS AG, Munich (DE)

( * ) Notice: Subject to any disclaimer, the term of this patent is extended or adjusted under 35 U.S.C. 154(b) by 0 days.

(21) Appl. No.: 16/069,763

(22) PCT Filed: Jan. 13, 2017

(86) PCT No.: PCT/EP2017/050688
§ 371 (c)(1),
(2) Date: Jul. 12, 2018

(87) PCT Pub. No.: WO2017/121861
PCT Pub. Date: Jul. 20, 2017

(65) Prior Publication Data

US 2019/0058267 A1 Feb. 21, 2019

(30) Foreign Application Priority Data

Jan. 15, 2016 (ES) ..... 201630033
Feb. 1, 2016 (DE) ..... 10 2016 101 713

(51) Int. Cl.
*H01R 4/28* (2006.01)
*H01R 4/48* (2006.01)
*H01R 4/52* (2006.01)

(52) U.S. Cl.
CPC ..... *H01R 4/4827* (2013.01); *H01R 4/28* (2013.01); *H01R 4/48* (2013.01); *H01R 4/4809* (2013.01); *H01R 4/4818* (2013.01); *H01R 4/52* (2013.01)

(58) Field of Classification Search
CPC ..... H01R 4/28; H01R 4/48; H01R 4/4809; H01R 4/4818; H01R 4/4827; H01R 4/4836; H01R 4/4845; H01R 4/52
See application file for complete search history.

(56) References Cited

U.S. PATENT DOCUMENTS 5,860,837 A * 1/1999 Bock ..... H01R 4/4827 439/828
6,126,494 A * 10/2000 Fuchs ..... H01R 4/4845 439/441
6,347,031 B1 2/2002 Kawamoto
7,344,422 B2 3/2008 Helmreich
8,052,447 B2 11/2011 Feye-Hohmann
8,388,387 B2 3/2013 Koellmann
(Continued)

FOREIGN PATENT DOCUMENTS

CN 2494045 Y 5/2002
CN 101340024 A 1/2009
(Continued)

*Primary Examiner* — Vanessa Girardi
(74) *Attorney, Agent, or Firm* — Slater Matsil, LLP

(57) ABSTRACT

A holding and contacting device is disclosed. In an embodiment a holding and contacting device includes a cage defining a cable path through the cage and a spring element protruding into the cable path and configured to apply a clamping force onto a cable placed along the cable path, wherein the spring element and the cage comprise a metal.

21 Claims, 2 Drawing Sheets

(56) References Cited

U.S. PATENT DOCUMENTS

| | | | | |
|---|---|---|---|---|
| 8,636,523 | B2 | 1/2014 | Nagasaki et al. | |
| 8,992,269 | B2 | 3/2015 | Salzmann et al. | |
| 9,373,899 | B2 | 6/2016 | Wu | |
| 9,397,419 | B2 * | 7/2016 | Kang | H01R 12/53 |
| 9,466,921 | B2 | 10/2016 | Takane | |
| 2004/0102078 | A1 * | 5/2004 | Miyoshi | H01R 4/4836 439/387 |
| 2008/0286996 | A1 | 11/2008 | Tuerschmann et al. | |

FOREIGN PATENT DOCUMENTS

| | | | |
|---|---|---|---|
| CN | 1267930 | A | 9/2009 |
| CN | 202025907 | U | 11/2011 |
| CN | 103378203 | A | 10/2013 |
| CN | 104466465 | A | 3/2015 |
| DE | 4231244 | A1 | 3/1994 |
| DE | 202004000418 | U1 | 6/2005 |
| DE | 102005028063 | B3 | 10/2006 |
| DE | 102005043877 | A1 | 3/2007 |
| DE | 102007035336 | B3 | 2/2009 |
| DE | 102008032837 | A1 | 1/2010 |
| DE | 102010024809 | A1 | 12/2011 |
| DE | 102015102840 | A1 | 3/2016 |
| EP | 1555723 | A1 | 7/2005 |
| JP | H0645261 | U | 6/1994 |
| JP | 2003346932 | A | 12/2003 |
| JP | 2007123272 | A | 5/2007 |
| JP | 2008130337 | A | 6/2008 |
| JP | 2009043711 | A | 2/2009 |
| JP | 2012028042 | A | 2/2012 |
| JP | 2015015112 | A | 1/2015 |
| JP | 2015065003 | A | 4/2015 |
| JP | 2015090822 | A | 5/2015 |

* cited by examiner

SPRING CLIP ELECTRICALLY CONNECTING A WIRE AND ELECTRONIC COMPONENT

This patent application is a national phase filing under section 371 of PCT/EP2017/050688, filed Jan. 13, 2017, which claims the priority of Spanish patent application P201630033, filed Jan. 15, 2016 and German patent application 10 2016 101 713.2, filed Feb. 1, 2016, each of which is incorporated herein by reference in its entirety.

TECHNICAL FIELD

The present invention concerns a holding and contacting device. The device is configured to mechanically fix a cable to an electronic component, in particular to a power electronic component. Furthermore, the device is configured to establish an electrical contact between the cable and the component.

SUMMARY OF THE INVENTION

Embodiments provide a holding and contacting device with improved properties. Embodiments provide a holding and contacting device which comprises a cage which defines a cable path through the cage and a spring element which protrudes into the cable path and which is configured to apply a clamping force onto a cable placed along the cable path, wherein the spring element and the cage comprise a metal.

The cable can be mechanically fixed by the clamping force. In particular, the holding and contacting device can be configured such that the spring element is arranged on one side of a clamped cable and a component and a lower wall of the cage are arranged on the other side of the cable, thereby clamping the cable such that it is mechanically fixed.

Further, an electrical connection can be formed between the cable and the component when the cable is pressed onto the component.

By providing a cage and a spring element, both comprising a metal, it can be ensured that the holding and contacting device is temperature-resistant up to high temperatures. High temperatures may occur as a result of strong currents inside the cable. The metal material of the cage and the spring element is chosen such that this material is not damaged or deformed by the high temperatures. In this way, it is possible to provide a holding and contacting device suitable for power electronic components which typically handle high levels of current.

The cage and the spring element may be free from any plastic materials. Such materials are usually less resistant against high temperatures.

The holding and contacting device is very unlikely to suffer from fatigue of its materials. The spring element may be designed such that it is able to withstand huge amount of compression-and-relaxation cycles as well as thermal cycles, thereby making it resistant against material fatigues.

Preferably, the spring element and the cage comprise the same metal. Accordingly, the spring element and the cage have the same coefficient of thermal expansion. Thus, a heating of the holding and contacting device during operation of the device may not create any mechanical tension between the spring element and the cage.

In a preferred embodiment, the spring element and the cage may be integrally made out of a single piece of sheet metal. In particular, the holding and contacting device may be formed from the single piece of sheet metal by a manufacturing process including a step of cutting the sheet metal and several steps of bending the sheet metal. The spring element may be formed integral with the cage.

Forming the spring element and the cage out of the single piece of sheet metal allows to minimize the amount of used raw material in the construction of the holding and contacting device. Only a minimum amount of sheet material may be wasted during the manufacture of the device. Accordingly, the costs for the manufacturing process can be reduced. Also, assembling costs are reduced if the whole device is one single piece.

Furthermore, forming the spring element and the cage out of the single piece of sheet metal prevents any problems that may occur due to a disengagement of the spring element from the cage. As the spring element may be formed integrally with the cage, it cannot be disengaged from the cage during the use of the holding and contacting device.

Further, the use of the spring element and the cage formed from the single piece of sheet metal allows to construct a maintenance-free holding and contacting device. In particular, the spring element may not be moved relative to the cage by vibrations or temperature cycles if the spring element and the cage are formed from the single piece of sheet metal. In contrast to this, if the spring element and/or the cage would comprise plastic parts, the risk of unintended movements due to vibrations or temperature cycles during normal operation would be significantly higher.

Accordingly, there is no need to re-adjust a cable fixed by the holding and contacting device which comprises a metal part, instead of plastic parts, after the device has experienced significant vibrations and/or temperature changes as the mechanical connection is not loosened by operational vibrations or temperature changes.

According to one embodiment, the spring element and the cage may be positively locked to each other. A positive lock of the spring element and the cage may also result in a holding and contacting device wherein a cable fixed by the device cannot be loosened by vibrations and/or temperature changes. Accordingly, no maintenance, e.g., re-adjusting the cable, is required within normal operation of the device.

The mass of the spring element may be small relative to the force applied by the spring element to the cable. Thus, the spring element may be virtually vibration proof.

In one embodiment, the spring element may be configured such that a magnitude of the clamping force applied to a cable placed along the cable path depends on the diameter of the cable, wherein the spring element is configured to apply a stronger clamping force on a cable having a first diameter than on a cable having a second diameter which is smaller than the first diameter.

Such a configuration may be achieved by a spring element which is shaped such that it is stronger deformed by the cable having the first diameter than by the cable having the second diameter. A stronger deformation of the cable may result in the application of a stronger clamping force.

The spring element may be configured to apply a clamping force which is sufficient to mechanically fix the cable regardless of the diameter of the cable. Typically, a cable having a larger diameter also has a larger weight such that a stronger force is required to fix the cable. As the holding and contacting device may be constructed such that the applied clamping force is increased for cables having an increased diameter, it can be ensured that a strong enough force is applied for cables having a large diameter and at the same time no excessive force is applied to a cable having a small diameter. Such an excessive force would otherwise, in the worst case, damage the cable having a small diameter.

Thus, the holding and contacting device is able to fit a wide range of different cable diameters.

The cable can be either a braided copper cable or a solid wire. The braided copper cable can comprise lugs or can be free from lugs. For some cases, lifting of a release pry may be necessary prior to insertion of the cable. Once the cable is inside, the release pry can be released and, therefore, the spring force will then be applied to the cable and create the mechanical and electrical connection.

The spring element may be configured to apply the clamping force in a direction that is perpendicular to the cable path. Thereby, a cable placed along the cable path may be fixed in its position.

In one embodiment, the spring element and the cage may consist of stainless steel.

Stainless steel provides multiple advantages. Stainless steel is temperature-resistive up to high temperatures such that heat due to strong currents in the cable may not damage the holding and contacting device. Moreover, stainless steel is non-magnetic in its annealed condition. The holding and contacting device can be produced using cold-work methods, in particular stamping and bending. However, the material may become slightly magnetic after these processes anyway. Further, stainless steel is non-corrosive. These material properties help to provide a long lifetime of the device as the cage and the spring element will not be damaged by magnetic fields or corrosion.

Further, the spring may comprise a sharp edge which faces towards the cable path. In addition to the clamping force which is applied by an abutment of the spring element to the cable, the sharp edge may enter into a surface material of the cable and form a claw which further fixes the cable.

The holding and contacting device may be configured to establish an electrical and mechanical contact of a cable and a component. The component may be a power electronic component. The holding and contacting device may be configured to fix the component and the cable by the clamping force applied by the spring element.

The material of the cage and the spring element may be configured such that the established electrical contact can sustain even high levels of current, e.g., above 50 A. As discussed above, the use of a metallic material for the cage and the spring element allows to construct a device which is not damaged by the heat which is inevitably provided by such strong currents.

Additionally or alternatively, the spring may further comprises a release pry, wherein the release pry is configured such that pulling the release pry deforms the spring element such that no clamping force is applied to a cable arranged along the cable path. In particular, pulling the release pry away from the cable path deforms the spring element such that no clamping force is applied to a cable arranged along the cable path.

The release pry may allow an easy demounting of a cable fixed in the holding and contacting device. When the release pry is pulled, the spring element may be deformed such that the spring element is moved upwards, away from a lower wall of the cage. Thus, a cable which is clamped between the spring element and the lower wall of the cage may be removed easily when the release pry is pressed.

The same principle may apply when braided copper wire is introduced into the cable path. Before the braided copper wire can be inserted, the spring element has to be opened. Accordingly, the release pry needs to be pulled to open the spring element. Then, the braided copper wire can be introduced and once it is inside, the release pry can again be released and the spring element applies the clamping force to the cable and secures the connection.

In particular, the release pry may comprises at least one opening which is configured to be engaged with a tool for releasing the clamping force applied by the spring element. The holding and contacting device can be designed such that a cable can only be inserted into the device or removed from the device if the release pry is simultaneously engaged with a tool such that the clamping force applied by the spring element is temporarily released. This design may prevent any unintentional mounting or demounting of a cable to or from the device.

The holding and contacting device may further comprise an insulation block which surrounds the cage, wherein the insulation block comprises a hole which allows engaging the release pry with a tool. In particular, the insulation block may be designed such that the hole is the only possibility to engage the release pry. This design also help to improve the safety as it further prevents unintentional demounting of the cable. The hole may be parallel to the cable path.

The spring may comprises a metal band, wherein a first end of the metal band is fixed to the cage. The second end of the metal band may protrude out of the cage and may form the release pry.

The spring element may comprise an abutment section which is configured to abut a cable placed along the cable path and which is configured to apply the clamping force onto the cable. In particular, the sharp edge may be arranged in the abutment section of the spring element.

According to another aspect, the present invention concerns an assembly comprising the above-described holding and contacting device, a cable and a power electronic component, wherein the holding and contacting device establishes an electrical and mechanical contact of the cable and the power electronic component.

BRIEF DESCRIPTION OF THE DRAWINGS

Further features and refinements become apparent from the following description of the exemplary embodiments in connection with the accompanying figures.

FIGS. 1 and 2 show perspective views of a holding and contacting device 1.

DETAILED DESCRIPTION OF ILLUSTRATIVE EMBODIMENTS

Figure 1:
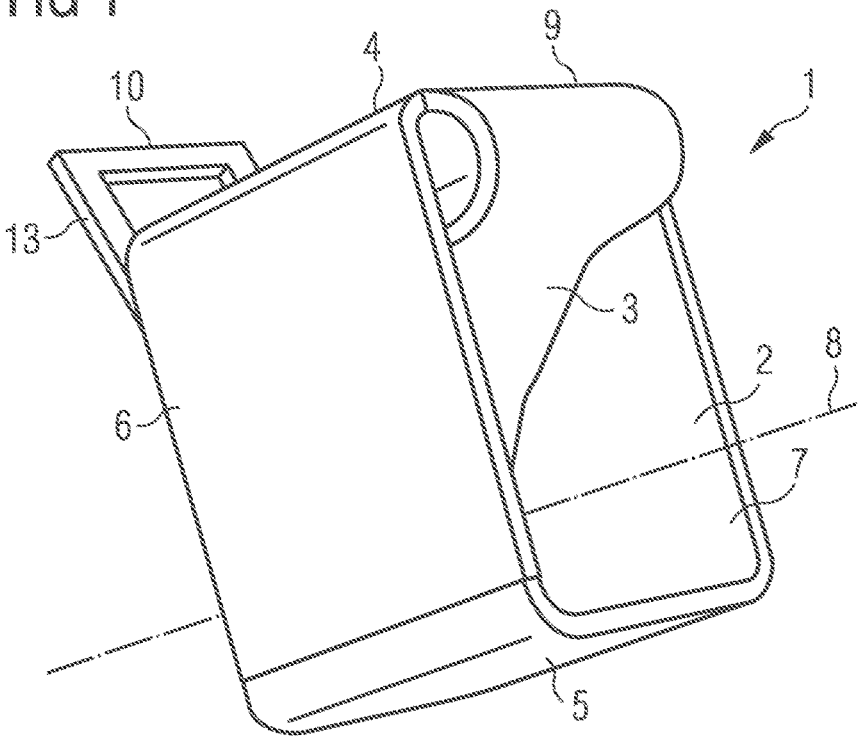
FIG. 1 shows a perspective view of a holding and contacting device.

The holding and contacting device 1 comprises a cage 2 and a spring element 3. The device 1 is configured for providing an electrical and mechanical contact of a cable and a component which can be arranged inside the cage 2. The component can be a power electronic component, e.g., a power electronic capacitor.

The cage 2 comprises four walls 4, 5, 6, 7. In particular, the cage 2 comprises an upper wall 4 and a lower wall 5 which is arranged opposite to the upper wall 4. Further, the cage 2 comprises two sidewalls 6, 7 which connect the upper wall 4 and the lower wall 5. Thus, the cage 2 has the shape of a cuboid wherein two opposing walls are missing. Thereby, a cable path 8 is defined which runs through the cage 2. A cable may be arranged along the cable path 8.

The spring element 3 protrudes into the cable path 8. The spring element 3 is fixed to the upper wall 4 of the cage 2. The spring element 3 comprises a metal band. A first end 9 of the spring element 3 is fixed to the cage 2. In particular, the first end 9 is fixed to the upper wall 4. The spring element 3 has a curved shape such that a part of the spring element 3 protrudes into the cable path 8. A second end 10 of the spring element 3 which is arranged opposite to the first end 9 is arranged outside of the cable path 8.

The spring element 3 comprises an abutment section 11. The abutment section 11 is the section of the spring element 3 which is arranged closest to the lower wall 5 of the cage 2. When a cable is arranged inside the cable path 8, the abutment section 11 is configured to be pressed onto the cable, thereby exerting a clamping force onto the cable. The clamping force is exerted in a direction perpendicular to the cable path 8.

The holding and contacting device 1 is formed from a single sheet of metal. In particular, the single sheet of metal is cut and bended several times to form it into the holding and contacting device 1. Accordingly, the spring element 3 is formed integrally with the cage 2 from the same sheet of metal.

Alternatively, the spring element 3 and the cage 2 may be formed from two separate sheets of metal which are afterwards attached to each other, e.g., in a positively locked manner.

The cage 2 and the spring element 3 are made out of a metal. In particular, the cage 2 and the spring element 3 are made out of the same metal, preferably stainless steel. This material is non-magnetic and non-corrosive, thereby ensuring along-life-service.

Further, the spring element 3 comprises a sharp edge 12. The sharp edge 12 is formed by an edge in an opening which is arranged in the material of the spring element 3. The sharp edge 12 extends in a direction which is perpendicular to the cable path 8. The sharp edge 12 is arranged in the abutment section 11 of the spring element 3. In particular, the sharp edge 12 is formed at the point of the spring element 3 which is closest to the lower wall 5 of the cage 2.

The spring element 3 is configured such that the abutment section 11 is pressed against a cable when the cable is arranged along the cable path 8, thereby creating a clamping connection between the spring element 3 and the cable. This connection will fix the cable inside the holding and contacting device 1.

Further, the spring element 3 comprises a release pry 13. The release pry 13 is configured to release a connection of the holding and contacting device 1 and the cable. When the release pry 13 is pulled, the spring element 3 is deformed, thereby releasing the clamping force from the cable and allowing to detach the cable from the holding and contacting device 1.

The release pry 13 comprises a first opening 17 and a second opening 18. The first opening 17 is arranged closer to the second end 10 than the second opening 18. In alternate embodiments, the release pry 13 may comprise only one opening or more than two openings.

Figure 2:
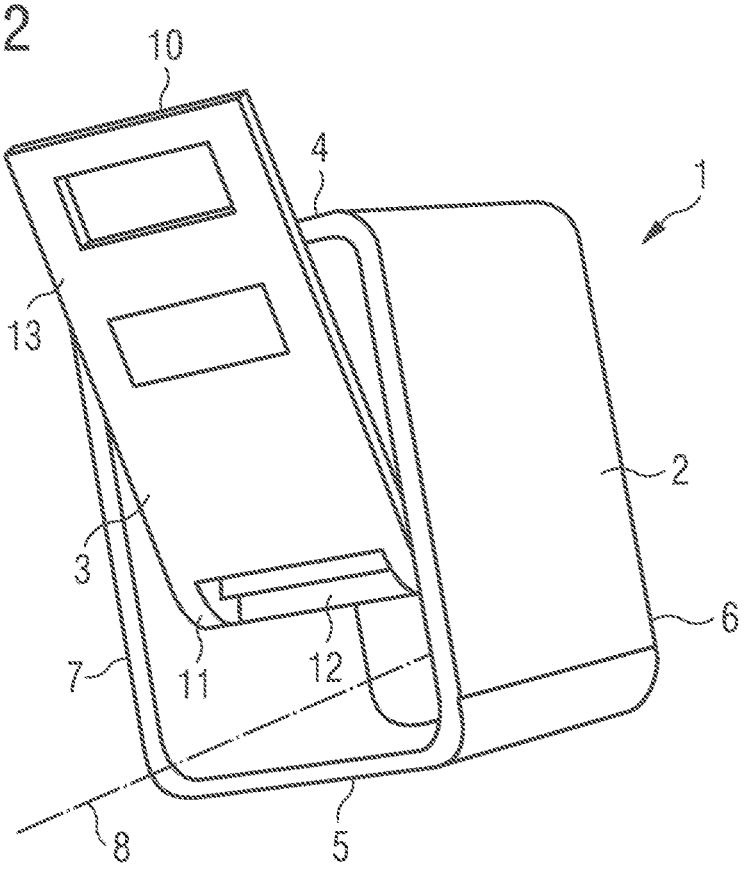
FIG. 2 shows another perspective view of the holding and contacting device from a different perspective.

Additionally, the holding and contacting device 1 comprises an insulation block 19 which surrounds the cage 2. The insulation block 19 comprises an insulating material. The insulation block 19 is not shown in FIGS. 1 and 2. The insulation block 19 is shown in the FIGS. 3 and 4 which show cross-sectional views of the holding and contacting device 1.

The insulation block 19 protects the cage 2 against mechanical forces which may be applied from the outside. In particular, the insulation block 19 may attenuate any mechanical force being applied to the holding and contacting device 1.

Further, the insulation block 19 comprises a hole 20 which is extends in a direction parallel to the cable path 8. The insulation block 19 is shaped such that the only possibility to engage the release pry 13 is via the hole 20. It is possible to insert a tool, e.g., a flat standard screwdriver, into the hole such that the tool engages one of the openings 17, 18 of the release pry 13. Then, the release pry 13 can be pulled in a direction away from the cable path 8 by the tool. Depending on the position of the release pry 13, the tool can engage either the first opening 17 or the second opening 18.

When the release pry 13 is pulled in a direction away from the cable path 8, the abutment section 11 of the spring element 3 is moved away from the cable path 8, thus allowing to remove a cable from the device 1.

Thereby, it can be ensured that no accidental loosening of the connection can occur since only the pulling of the release pry 13 and simultaneously extraction of the cable allows to detach the cable from the holding and contacting device 1.

The release pry 13 is configured to deform the spring element 3 in a manner such that its abutment section 11 is moved further away from the lower wall 5 of the cage 2.

Figure 3:
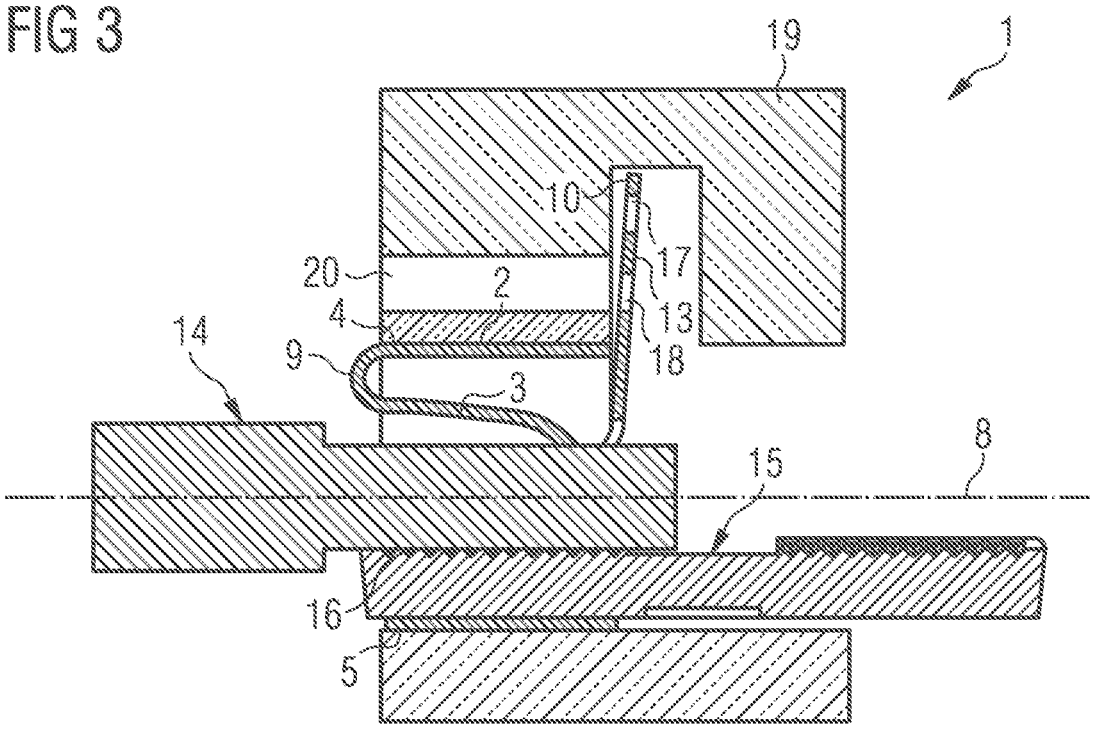
FIG. 3 shows a cross-sectional view of an assembly comprising a holding and contacting device, a cable and a component.

FIG. 3 shows a cross-sectional view of an assembly comprising the holding and contacting device 1, a cable 14 and a component 15. The component 15 is a power electronic component. The component 15 comprises a busbar 16 which is used to electrically contact the component 15. The cable 14 consists of copper or another material.

The spring element 3 exerts a clamping force onto the cable 14, thereby pressing the cable 14 onto the component 15. In particular, the cable 14 and the component 15 are clamped between the spring element 3 and a lower wall 5 of the cage 2. In particular, the cable 14 is pressed onto the busbar 16 of the component 15 such that an electrical current can flow from the cable 14 into the busbar 16. Accordingly, an electrical connection of the cable 14 and the component 15 is provided. Furthermore, the clamping force exerted by the spring element 3 onto the cable 14 mechanically fixes the cable 14 to the component 15. Thereby, the spring element 3 ensures that the cable 14 cannot move relative to the component 15.

The cable 14 is arranged between the component 15 and the spring element 3. Accordingly, the cable 14 is pressed onto a topside of the component 15. This design allows to arrange the component 15 in a low position, thereby enabling to construct a compact assembly.

It can be seen in FIG. 3 that the sharp edge 12 of the spring element 3 slightly enters into the material of the cable 14. Thereby, an additional fixation of the spring element 3 and the cable 14 is achieved as the sharp edge 12 is clawed into the material of the cable 14. This additional fixation further adds to the mechanical fixation of the cable 14 inside the cable path 8 due to the clamping force exerted by the spring element 3.

In order to disengage the cable 14 from the assembly, a user has to insert a tool into the opening 20 of the insulation block 19 such that the tool engages the second opening 18 of the release pry 13. Then, the release pry 13 can be pulled upwards, i.e., away from the cable, thereby deforming the spring element 3 such that the spring element 3 does no longer exert a clamping force onto the cable 14. Then the cable 14 can be removed. Accordingly, the second opening 18 allows to manually deform the spring element 3 when a cable 14 is arranged in the cable path 8 such that no clamping force is applied on the cable 14.

Figure 4:
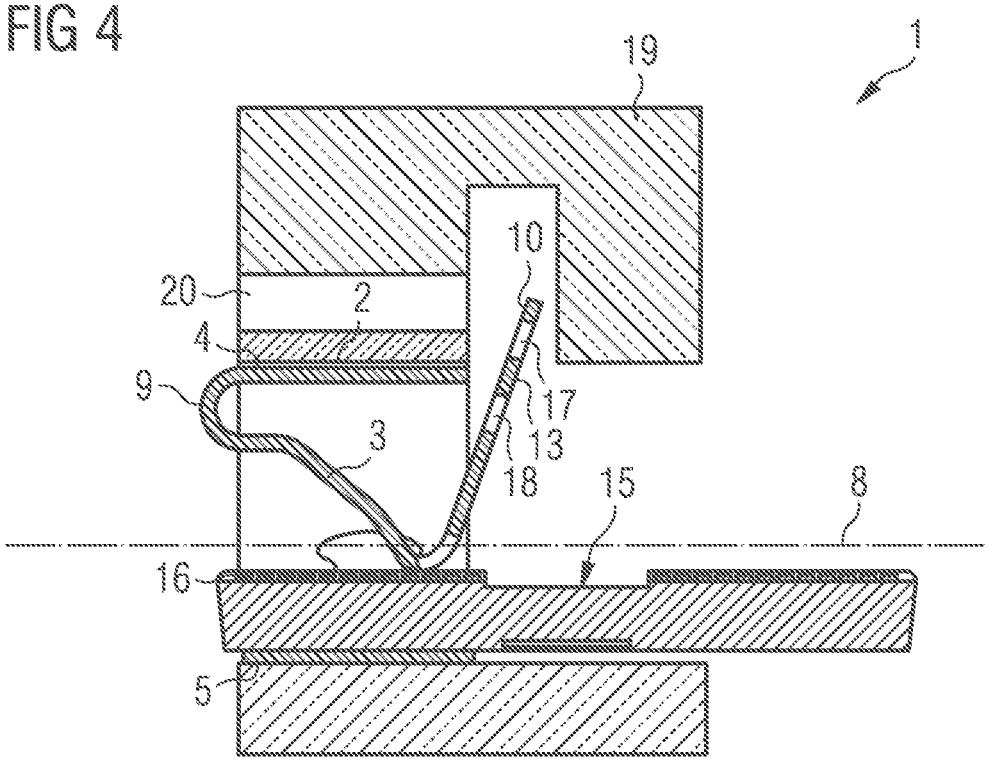
FIG. 4 shows a cross-sectional view of the assembly without the cable.

FIG. 4 shows the assembly of FIG. 3 without the cable 14. In this configuration, the spring element 3 is more relaxed than in the configuration shown in FIG. 3. The spring element 3 is dimensioned such that, if only the component 15 and no cable 14 is present in the cable path 8, the spring element 3 will abut the busbar 16 of the component 15 and the spring element 3 will apply a small clamping force onto the component 15. Thereby, it can be ensured that the holding and contacting device 1 remains in its place even if the cable 14 is removed.

The device 1 is configured such that it is able to connect the component 15 to a wide range of cables 14 having all kinds of different cable diameters. If a cable 14 is inserted into the cable path 8 in the configuration as shown in FIG. 4, the spring element 3 will be deformed such that its abutment section 11 is moved in a direction away from the lower wall 5 of the cage 2. The amount by which the spring element 3 is deformed depends on the diameter of the inserted cable 14. If a cable 14 having a rather small diameter is inserted into the cable path 8, the spring element 3 will be deformed by a rather small amount such that the spring element 3 will exert a small clamping force onto the small cable 14 and the component 15. The spring element 3 is dimensioned such that this clamping force is sufficient to fix the cable 14 to the component 15.

If a cable 14 having a bigger diameter is inserted into the cable path 8, the spring element 3 will be deformed by a larger amount. Accordingly, the spring element 3 will exert a stronger clamping force onto the cable 14, thereby pressing it onto the component 15. Again, this force is sufficient to fix the cable 14 to the component 15.

Accordingly, the holding and contacting device 1 is constructed such that a stronger force is exerted onto a cable 14 having a first diameter than on a cable having a second diameter which is smaller than the first diameter. The cable 14 having the first diameter will deform the spring element 3 to a greater extent than the cable having the second diameter. A greater deformation of the spring element 4 results in a stronger clamping force.

The holding and contacting device 1 is constructed such that it is virtually impossible for the cable 14 to be released accidentally. Due to the shape of the spring element 3 and the sharp edge 12, a clamping is constructed which allows only purposely release of the cable 14.

In order to insert a cable 14, the user first has to engage enter a tool into the hole 20 such that the tool engages the first opening 17 of the release pry, thereby enabling to pull the release pry 13 away from the busbar 16. Thereby, the spring element 3 is deformed such that it provides space along the cable path 8, allowing to insert the cable 14 into the cable path 8. Accordingly, the first opening 17 allows to manually deform the spring element 3 when no cable 14 is arranged in the cable path 8 such that no clamping force is applied on the component 15.

We claim:

1. A holding and contacting device comprising:

a cage defining a cable path through the cage, the cable path extending through the cage from a first cage edge to a second cage edge opposite first cage edge face, the cable path defined by at least an upper cage wall;

an insulation block surrounding the cage with the upper cage wall disposed between an upper insulation block wall and the cable path, the insulation block having a cavity extending from the upper insulation block wall into the insulation block, and wherein the insulation block has an insulation block opening extending from the first face to the cavity, and wherein the insulation block opening is separated from the upper wall of the cage and the cable path by a first portion of the insulation block comprising the upper insulation block wall; and a spring element protruding into the cable path and configured to apply a clamping force onto a cable placed along the cable path, the spring element having a first end disposed at the upper wall of the cage, the spring element further having a second end that is opposite the first end of the spring element and that extends from the cable path past the upper insulation block wall into the cavity;

wherein the spring element and the cage comprise a metal, wherein the spring element further comprises a release pry at the second end of the spring element, wherein the spring element is configured to be deformed such that no clamping force is applied to the cable placed along the cable path when the release pry is pulled, and wherein the spring element is configured to extend from the upper wall across the cable path when the release pry is in a released state and is configured to retract from a portion of the cable path when the release pry is in a pulled state such that the cable is insertable into the cable path when the release pry is pulled.

2. The holding and contacting device according to claim 1, wherein the spring element and the cage comprise the same metal.

3. The holding and contacting device according to claim 1, wherein the spring element and the cage are integrally made out of a single piece of sheet metal.

4. The holding and contacting device according to claim 1, wherein the spring element and the cage are positively locked to each other.

5. The holding and contacting device according to claim 1, wherein the spring element is configured to apply a magnitude of the clamping force a to the cable placed along the cable path depending on a diameter of the cable, and wherein the spring element is configured to apply a stronger clamping force on the cable having a first diameter than on a cable having a second diameter which is smaller than the first diameter.

6. The holding and contacting device according to claim 1, wherein the spring element is configured to apply the clamping force in a direction that is perpendicular to the cable path.

7. The holding and contacting device according to claim 1, wherein the spring element and the cage consist essentially of stainless steel.

8. The holding and contacting device according to claim 1, wherein the spring element comprises an abutment section configured to abut the cable placed along the cable path and configured to apply the clamping force onto the cable.

9. The holding and contacting device according to claim 1, wherein the holding and contacting device is configured to establish an electrical and mechanical contact of the cable and a component.

10. The holding and contacting device according to claim 1, wherein a material of the cage and the spring element is configured such that an established electrical contact is able to sustain a high levels of current above 50 A.

11. The holding and contacting device according to claim 1, wherein the first end of the spring element is fixed to the upper wall of the cage.

12. The holding and contacting device according to claim 1, wherein the spring element comprises a sharp edge which faces towards the cable path.

13. The holding and contacting device according to claim 12, wherein the spring element comprises an abutment section configured to abut the cable placed along the cable path and configured to apply the clamping force onto the cable, wherein the sharp edge is arranged in the abutment section.

14. The holding and contacting device according to claim 1, wherein the release pry comprises at least one opening which is configured to be engaged with a tool for releasing the clamping force applied by the spring element.

15. The holding and contacting device according to claim 14, and wherein, when the cable path is free of any cable, the at least one opening of the release pry aligns with the insulation block opening to permit engaging the at least one opening of the release pry with a tool through the insulation block opening.

16. An assembly comprising:

the holding and contacting device according to claim 1; and a power electronic component, wherein the holding and contacting device establishes a mechanical contact of the holding and contacting device and the power electronic component.

17. The assembly according to claim 16, wherein the spring element is dimensioned such that, when only the power electronic component and no cable is present in the cable path, the spring element abuts the power electronic component and the spring element applies a clamping force onto the power electronic component.

18. The assembly according to claim 16, further comprising the cable wherein the holding and contacting device establishes an electrical and mechanical contact of the cable and the power electronic component.

19. The holding and contacting device according to claim 1, wherein the release pry comprises a first opening and a second opening, wherein, depending on a position of the release pry, a tool can engage, through the insulation block opening, either the first opening or the second opening.

20. The holding and contacting device according to claim 19, wherein the first opening is configured to allow manual deformation of the spring element when no cable is arranged in the cable path.

21. The holding and contacting device according to claim 19, wherein the second opening is configured to allow manual deformation of the spring element when a cable is arranged in the cable path.

* * * * *